US006237684B1

(12) United States Patent
Bouligny, Jr. et al.

(10) Patent No.: US 6,237,684 B1
(45) Date of Patent: May 29, 2001

(54) PIPE STRING HANDLING APPARATUS AND METHOD

(75) Inventors: Vernon J Bouligny, Jr., New Iberia; Michael W Olivier, Broussard, both of LA (US)

(73) Assignee: Frank's Casing Crewand Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/330,410

(22) Filed: Jun. 11, 1999

(51) Int. Cl.[7] ..... E21B 19/16; E21B 19/00

(52) U.S. Cl. ..... 166/77.52; 166/75.14

(58) Field of Search ..... 166/75.14, 77.1, 166/77.51, 77.52, 378, 379, 380; 175/52, 85; 211/70.4; 414/22.51, 22.52, 22.53, 22.54, 22.56, 22.57, 22.58, 22.59, 22.61, 22.62, 22.63, 22.64, 22.65, 22.66, 22.67, 22.68, 22.69, 22.71

(56) References Cited

U.S. PATENT DOCUMENTS 2,689,139 * 9/1954 Jones et al. ..... 285/123.8
3,094,852 * 6/1963 Taylor ..... 464/183
4,697,830 * 10/1987 Wood et al. ..... 285/27
5,755,289 * 5/1998 Angman et al. ..... 166/378

* cited by examiner

*Primary Examiner*—David Bagnell
*Assistant Examiner*—Jennifer M Hawkins
(74) *Attorney, Agent, or Firm*—John D. Jeter

(57) ABSTRACT

A support table with an upwardly extending tubular neck engages the lower surface of the upper connector of the string to support the string while resting on a floor-level support. The neck is small enough for an elevator to close around the neck and still engage the outer portion of the lower surface of the connector. The support table is split into separable parts for opening to install and remove it from around the string. The base of the support table is large enough to stand on the rig floor level support. Optionally, a liner is provided for an oversize elevator bore to provide an axially short, inwardly extending, lower flange. On the upper end the liner has an outwardly extending flange to engage the usual load bearing surface of the elevator. The liner is split to open with the elevator, with each portion secured to the elevator by at least one fastener. To accept connectors with a lower plane surface too small to accommodate both support neck and elevator, a removable temporary substitute sleeve is provided for lifting the string.

15 Claims, 2 Drawing Sheets

PIPE STRING HANDLING APPARATUS AND METHOD

This invention pertains to apparatus and methods for handling pipe strings extending generally downward from drilling and production platforms. More specifically, it pertains to the use of apparatus to engage the shoulder of the pipe string connector such that an elevator and support table can individually support the pipe string load while sharing the downwardly facing load bearing area, or areas, of the pipe load supporting connector.

BACKGROUND

Since the rotary drilling system has been in use it has been commonplace to use a first elevator as a temporary substitute for a spider to support a tubular well string while a second elevator, supported by the bails of the traveling block, engages the lower shoulder of the top connector of a tubular joint being added to the string. When the last added pipe section is safely secured to the string, the top elevator then lifts the string to allow the first elevator to be slid aside. The string is then lowered by the second elevator until it engages the rig floor level support which is usually a landing table or rotary table cover plate. The traveling block bails are then removed from the second elevator and attached to the first elevator, by which a new pipe section is accessed, and the process is repeated. This is referred to as "circulating the elevators". The procedure is reversed to remove a tubular string from the well.

Several different pipe handling procedures have been developed to alter the handling procedure defined above but no single best way has evolved.

The process described above has naturally evolved to satisfy the need to handle risers approaching a platform from the sea bed below. Risers can usually afford connectors of larger outside diameter, compared with well string tubing, and there is usually enough surface to accept the loads, and contact areas, of both elevator and support table if the load transmitting elements are arranged for that purpose.

In some cases, the pipe string outer surfaces are very sensitive to surface damage. That sensitivity usually results from metal, surface, and heat treatment selection to best accept local chemical conditions. Each type of connection, however, can be supplied with a sleeve with mating surfaces that minimize localized stresses when lifting the string by surfaces the sleeve makes available.

It is desirable and an object of this invention to provide apparatus and methods to avoid the repeated disconnecting of the bails to circulate the elevators.

It is another object to simplify the nature, use, and cost of structure to serve the simple support function of the spider, and allow the novel support table and elevator to simultaneously engage the lifting areas of the string components.

It is still another object of the invention to provide a temporary sleeve to safely engage complex surfaces of the pipe and connector and to provide more usable surface, or surfaces, to engage the support table and elevator simultaneously to change support for the string to and from the elevator.

These and other objects, advantages, and features of this invention will be apparent to those skilled in the art from a consideration of this specification, including the attached claims and appended drawings.

SUMMARY OF INVENTION

The present invention utilizes a support table with an upwardly protruding tubular neck to support the suspended pipe string. The neck clears the elevator lower ledge and extends upward through the elevator bore to engage downwardly facing surfaces of the upper connector of the string. If the elevator has no lower ledge, one is provided in the form of a split tubular liner with an outwardly extending upper ledge and an inwardly extending lower ledge. The upper ledge engages the load lifting surface on the elevator and the lower ledge engages the downwardly facing load bearing area of the connector or a lower shoulder, or face, of a temporary lift sleeve. The split liner is, preferably, secured to the elevators such that it needs no opening hinges. If the downwardly facing load bearing surface of the connector has enough radial dimension, the support table may engage about half the shoulder area and the elevator can engage the outer half of that surface when shifting string load between support table and hook. The downwardly facing load bearing surface of the connector can be located at different axial levels, or stepped.

If the connector shoulder does not have enough bearing surface, or is tapered or rounded, a temporary lift sleeve is added below the connector to suitably engage available and usable surfaces on the string and provide substitute load bearing surfaces for lifting the string. The lift sleeve is short axially and has downwardly facing surfaces large enough to accept both the pipe string and the elevator. Both lift sleeve and support table are split to be opened to accept lateral movement of the string into their general centerlines. Either, or both, support table and lift sleeve can be hinged to admit pipe but either can be confined about the pipe by other means. Laterally sliding load bearing plates can be used with the support table. The support table can be handled well if each part of the split support table is attached to a laterally movable loading plate that rests on the rotary table cover plate or other structure. Sometimes a shock table that has a gas cushion bears the load of the support table.

The methods disclosed herein are designed to optimally use the novel apparatus elements of this invention.

DETAILED DESCRIPTION OF DRAWINGS

Figure 1:
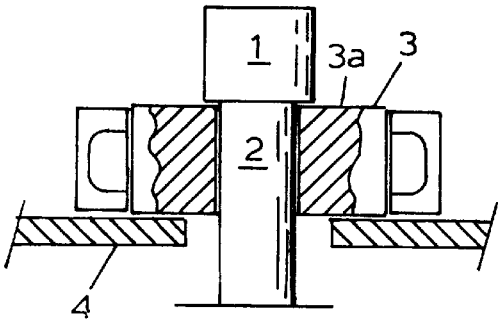
FIG. 1 is a side view, mostly cut away, of the apparatus of prior art.

In the drawings features that are well established in the art and do not bear upon points of novelty are omitted in the interest of descriptive clarity. Such omitted features may include threaded junctures, weld lines, sealing elements, pins and brazed junctures.

In FIG. 1, showing old art, pipe string 2 has connector 1 with lower surface la engaged by the top surface or recess 3*a* of elevator 3, which rests on rig floor level support structure 4. The elevator serves as a temporary spider substitute to suspend the string while another elevator is carried by the bails of the traveling block to engage the upper end of the joint to be added, or the string after that joint is added. When the traveling block lifts the string, the temporary spider, or elevator 3, can be removed to lower the string under control of the traveling block.

Figure 2:
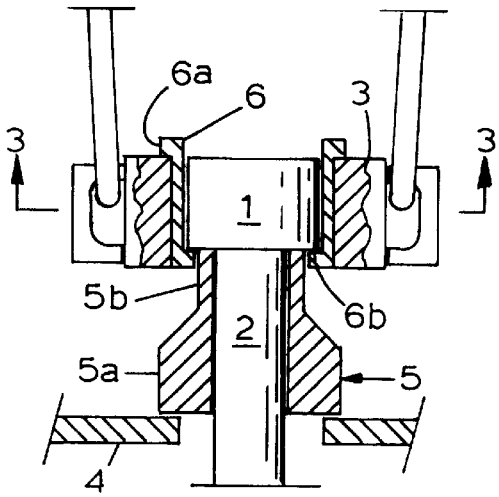
PRIOR ART FIG. 2
FIG. 2 is a side view, mostly cut away, similar to FIG. 1 with novel features illustrated.

In FIG. 2, elevator 3 has an oversize bore sleeved by liner 6. Liner 6 has flange 6*a* at the top to engage an upwardly facing surface of the elevator, and lower flange 6*b* to engage a downwardly facing surface of connector 1. The liner is split to function with the elevator manner of opening. Each part of the liner can be secured to the elevator by a screw (not shown) or by other means.

The lower flange of the liner accommodates neck 5*b* of support table 5. Pedestal portion 5*a* is shaped to be carried by the rig floor level support.

Figure 3:
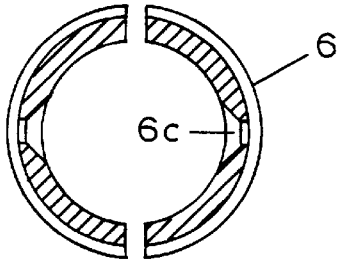
FIG. 3 is a sectional view taken along line 3—3

FIG. 3 is a section of the liner 6, taken along line 3—3 of FIG. 2, and illustrates a securing means, cap screw recesses 6*c*, for attachment to the elevator.

Figure 4:
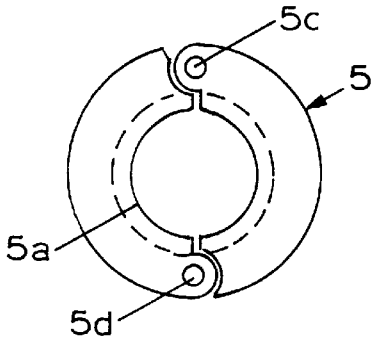
FIG. 4 is a bottom view of just the support table of FIG. 2.

FIG. 4 is a bottom view of the support table 5 of FIG. 3. The support table is shown with a hinged connection 5*c* to allow opening of the support table to apply and remove it from the string. Pin 5*d* secures the support table of this version in the closed position.

Figure 5:
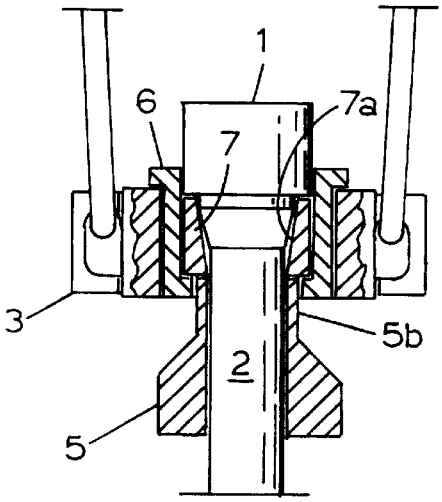
FIG. 5 is a side view, mostly cut away, of an optional form of the invention.

FIG. 5 is identical to FIG. 2 excepting the addition of lift sleeve 7. The lift sleeve 7 is used if the configuration of the connector and upset dimension of the end of pipe 2 forms a complex shape that does not readily accept the support table and elevator combination without surface damage. Surface 7*a* of the sleeve can be shaped to engage the available surfaces on the string for string lifting without causing damage. The sleeve then provides suitable substitute lifting surface areas to accept both elevator and support table. That surface can be a single plane, or stepped. If the surface is stepped, the lower surface may be extended below the elevator in the manner of the connector 10 of FIG. 6. The sleeve may be hinged and openable in the manner of the support table shown by FIG. 4. On site, two sleeves are needed, one to support the weight of the pipe string on the support table and another to support the next section of the riser when it is picked up by the elevator attached to the traveling block. In FIG. 5 the elevator shown would be in the position shown only after lowering the string to rest on the support table, and before opening the elevator to proceed with other activity.

Figure 6:
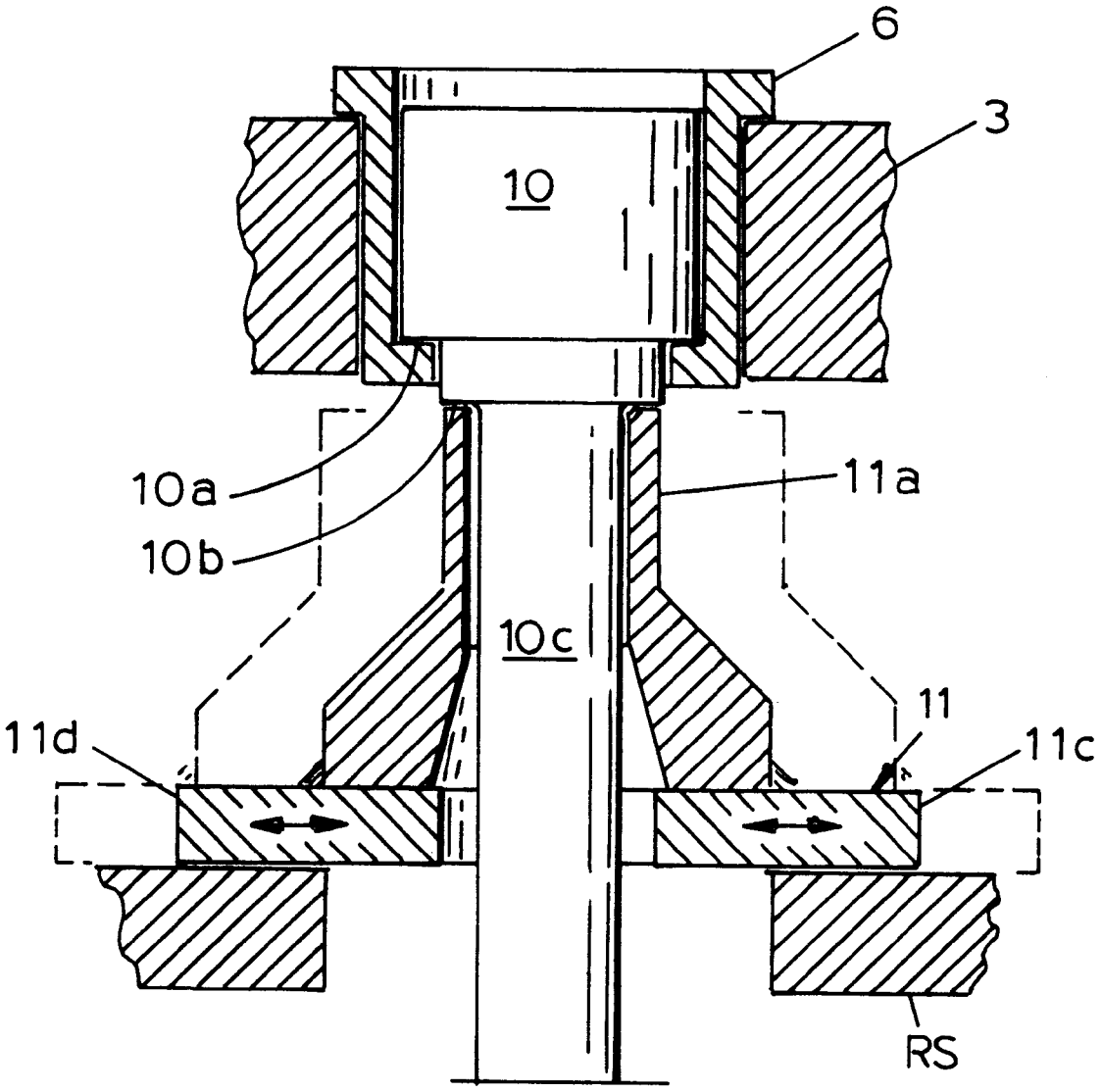
FIG. 6 is a side view of an alternate form of novel parts of the invention.

FIG. 6 shows an alternate form of the split support table 11 and manner of opening the it for admission of pipe 10*c* to the neck support 11*a*. The connector shown has stepped load bearing surfaces 10*a* and 10*b*. The elevator engages surface 10*a* and the support table engages surface 10*b*. By sizing the neck to pass through the bore of sleeve 6, less vertical precision is required in manipulation of the elevator 3 because it can ride down over the neck while closed, and rise to engage the connector without disturbing the support table. Plates 11*c* and 11*d* shuttle as shown by arrows to rest atop rig related structure RS, such as a rotary table cover plate, to open and close the support table.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, we claim:

1. A pipe string handling apparatus usable on oil field rigs for pipe strings with connectors having downwardly facing load bearing surfaces, the apparatus comprising:

a) a support table with a base and an upwardly extending tubular neck with an upper surface arranged to engage part of said surfaces;

b) a rig elevator with a bore to accommodate said neck and to provide an upwardly facing surface to engage part of said downwardly facing load bearing surfaces.

2. The apparatus of claim 1 wherein said support table is split into two separable hingedly connected parts for opening to accept pipe laterally into the bore of said tubular neck.

3. The apparatus of claim 2 wherein said support table is provided with a releasable latch to secure it in a closed position about said pipe string.

4. The apparatus of claim 1 wherein said upwardly facing surface is provided by an insert situated, supported, and secured in said elevator.

5. The apparatus of claim 4 wherein said insert has an outwardly extending flange with a lower surface to engage the upwardly facing surface of said elevator.

6. The apparatus of claim 1 wherein said support table is split for opening to admit said pipe by lateral movement of said separable parts of said support table.

7. The apparatus of claim 6 wherein each portion of said support table is secured to a load bearing shuttle plate for lateral movement to open the support table.

8. A pipe string handling apparatus usable on oil field rigs, the apparatus comprising:

a) a support table with a base to rest on a rig structure and an upwardly extending tubular neck;

b) a rig elevator with a generally central bore and upwardly facing surface;

c) a split liner to fit said bore, with an upper flange to engage said surface and a lower inwardly extending flange to abut a downwardly facing surface of a pipe string connector for lifting the bore of said inwardly extending flange to accept said neck therethrough.

9. The apparatus of claim 8 wherein a lift sleeve is provided and situated around said pipe string, to transfer pipe string load between said inwardly extending flange, and said connector.

10. A method for the manipulation of a pipe handling means to run pipe strings comprising pipe sections and connectors, serially assembled, into and from wells, the method for assembling the pipe string comprising the steps of:

a) installing a pipe string in said well and suspending said string from an upper connector, with a downwardly facing load bearing surface thereon situated upon a rig supported support table having a neck that occupies only part of said surface;

b) supporting a pipe section to be added to said string by engaging part of the downwardly facing load bearing surface on a second connector at the upper end of said section with an elevator;

c) stabbing and assembling said section, with said second upper end connector attached, to said string;

d) lifting the string with the elevator engaging said upper end connector, to free the support table, and opening the support table;

e) lowering the string and re-installing the support table about the string to engage the part of the connector load bearing surface not occupied by the elevator and allowing the support table to support the string; and f) opening said elevator, removing it from said strings and securing another section to be added to said string.

11. The method of claim 10 wherein a temporary substitute removable sleeve with a substitute lifting surface is situated around said string below said upper connector to engage said downwardly facing load bearing surfaces on said connector and wherein said string is supported by said elevator which engages part of said substitute lifting surface on said substitute sleeve to lift said string.

12. The method of claim 11 wherein said lift sleeve is circulated to alternately provide lifting surfaces on the last two connectors added to the string.

13. A method for the manipulation of a pipe handling means to run pipe strings comprising pipe sections and connectors, serially assembled, into and from wells, the method for dismantling the pipe string comprising the steps of:

a) supporting the pipe string on a support table with a neck that engages a downwardly facing surface on an upper connector on said string and accepts the bore of an elevator to engage part of said surface;

b) supporting said string with said elevator, opening said support table, and raising the pipe string with said elevator until a subsequent lower connector is in position to engage the support table neck;

c) closing the support table and lowering the string to engage the support table for support;

d) threadedly disengaging the upper portion of the string to remove at least one pipe section, and setting the removed portion of the string aside;

e) lowering the elevator to again engage the uppermost connector on surfaces not occupied by the support table and lifting the string to access the next portion of said pipe string for removal.

14. The method of claim 13 wherein a temporary substitute removable sleeve with a substitute lifting surface is situated around said string below said upper connector to engage said downwardly facing load bearing surfaces on said connector and wherein said string is supported by said elevator which engages part of said substitute lifting surface on said substitute sleeve to lift said string.

15. The method of claim 14 wherein said lift sleeve is circulated to alternately provide lifting surfaces on the last two connectors added to the string.

* * * * *